US006398192B1

(12) United States Patent
Albritton

(10) Patent No.: US 6,398,192 B1
(45) Date of Patent: Jun. 4, 2002

(54) BREAKAWAY SUPPORT POST FOR HIGHWAY GUARDRAIL END TREATMENTS

(75) Inventor: James R. Albritton, Aledo, TX (US)

(73) Assignee: TRN Business Trust, Dallas, TX (US)

( * ) Notice: Subject to any disclaimer, the term of this patent is extended or adjusted under 35 U.S.C. 154(b) by 0 days.

(21) Appl. No.: 09/358,017

(22) Filed: Jul. 19, 1999

Related U.S. Application Data

(60) Provisional application No. 60/115,122, filed on Jan. 6, 1999.

(51) Int. Cl.[7] ..... E01F 15/00

(52) U.S. Cl. ..... 256/13.1; 256/1; 256/DIG. 5; 404/6

(58) Field of Search ..... 256/13.1, DIG. 6, 256/1, DIG. 5, DIG. 2; 404/6

(56) References Cited

U.S. PATENT DOCUMENTS

| | | | | | |
|---|---|---|---|---|---|
| 79,141 | A | * | 6/1868 | McFarlin | 256/DIG. 2 |
| 398,078 | A | | 2/1889 | Peterson | |
| 446,852 | A | * | 2/1891 | Davis | 256/13 |
| 629,185 | A | * | 7/1899 | Arnold | 403/157 |

(List continued on next page.)

FOREIGN PATENT DOCUMENTS

| | | | | |
|---|---|---|---|---|
| AT | 278890 | | 2/1970 | E01F/15/00 |
| AU | A-21844/88 | | 11/1990 | E01F/13/00 |
| DE | 1 916 361 | | 5/1965 | |
| DE | 1534526 | * | 5/1969 | |
| DE | 278890 | * | 6/1969 | |
| DE | 3708861 | | 10/1988 | E01F/15/00 |
| EP | 0245042 | | 4/1987 | E01F/15/00 |
| FR | 2 386 667 | | 4/1977 | E04H/12/22 |
| FR | 2546932 | | 6/1983 | E01F/15/00 |
| GB | 2023695 | A | 1/1980 | |
| LU | 41444 | * | 9/1900 | |
| LU | 40467 | | 10/1961 | |
| WO | 98/50637 | * | 12/1998 | |
| WO | 00/40805 | | 7/2000 | E01F/15/04 |

OTHER PUBLICATIONS

Written Opinion for pending PCT Patent Application No. PCT/US99/30463, Nov. 22, 2000.

ET–2000 The Future of Highway Safety—SYRO (Printed in Dec. 1990/Rev. Oct. 1992.

(List continued on next page.)

*Primary Examiner*—Lynne H. Browne
*Assistant Examiner*—Ernesto Garcia
(74) *Attorney, Agent, or Firm*—Baker Botts L.L.P.

(57) ABSTRACT

A breakaway support post (18, 210) is provided for a highway guardrail system (10) to enhance the safety of a vehicle impacting with either the rail face of the associated guardrail (16) or one end of the guardrail facing oncoming traffic. The breakaway support post may have upper and lower portions (26, 28) with a releasable coupling assembly (29, 211) disposed therebetween to maintain the upper and lower portions generally aligned with each other prior to the impact of a vehicle with one end of the associated guardrail. The breakaway support post may also have releasable coupling assembly (301) disposed between the upper and lower portions and a cable (303). The releasable coupling assembly may allow the upper portion to separate from the lower portion. The cable may be released by the support post during separation of the upper and lower portions. The coupling assembly preferably provides sufficient support during a rail face impact to direct an impacting vehicle back onto the associated roadway.

3 Claims, 4 Drawing Sheets

U.S. PATENT DOCUMENTS

| | | | | | |
|---|---|---|---|---|---|
| 1,335,302 | A | | 3/1920 | Stout | |
| 1,473,118 | A | | 11/1923 | Miller-Masury | |
| 1,677,796 | A | * | 7/1928 | Parks | 248/548 |
| 2,089,929 | A | | 8/1937 | Brickman et al. | 256/13.1 |
| 2,091,195 | A | | 8/1937 | Dennebaum | 267/69 |
| 2,135,705 | A | | 11/1938 | Florance | 256/13.1 |
| 2,146,445 | A | | 2/1939 | Russert et al. | 189/29 |
| 2,309,238 | A | * | 1/1943 | Corey | 403/2 |
| 2,735,251 | A | * | 2/1956 | Dlugosch | 403/157 |
| 2,776,116 | A | | 1/1957 | Brickman | 256/13.1 |
| 3,308,584 | A | * | 3/1967 | Graham | 256/13.1 |
| 3,332,666 | A | * | 7/1967 | Gray | 256/13.1 |
| 3,349,531 | A | | 10/1967 | Watson | 52/296 X |
| 3,385,564 | A | | 5/1968 | Persicke | 256/13.1 |
| 3,417,965 | A | | 12/1968 | Gray | 256/13.1 |
| 3,450,233 | A | | 6/1969 | Massa | 188/1 |
| 3,499,630 | A | | 3/1970 | Dashio | 256/13.1 |
| 3,519,301 | A | | 7/1970 | Somnitz | 293/1 |
| 3,521,917 | A | * | 7/1970 | King | 256/13.1 |
| 3,567,184 | A | | 3/1971 | Yancey | 256/13.1 |
| 3,606,222 | A | | 9/1971 | Howard | 52/98 X |
| 3,637,244 | A | | 1/1972 | Strizki | 287/129 |
| 3,643,924 | A | | 2/1972 | Fitch | 256/13.1 |
| 3,680,448 | A | | 8/1972 | Ballingall et al. | 52/169.12 |
| 3,693,940 | A | | 9/1972 | Kendall et al. | 256/1 |
| 3,768,781 | A | | 10/1973 | Walker et al. | 256/1 |
| 3,776,520 | A | | 12/1973 | Charles et al. | 256/13.1 |
| 3,820,906 | A | | 6/1974 | Katt | 403/2 |
| 3,846,030 | A | | 11/1974 | Katt | 403/2 |
| 3,912,404 | A | * | 10/1975 | Katt | 403/2 |
| 3,925,929 | A | | 12/1975 | Montgomery | 49/35 |
| 3,951,556 | A | | 4/1976 | Strizki | 403/2 |
| 3,967,906 | A | | 7/1976 | Strizki | 403/2 |
| 3,981,486 | A | | 9/1976 | Baumann | 256/13.1 |
| 4,063,713 | A | | 12/1977 | Anolick et al. | 256/13.1 |
| 4,071,970 | A | | 2/1978 | Strizki | 40/607 |
| 4,126,403 | A | * | 11/1978 | Sweeney et al. | 403/2 |
| 4,183,695 | A | | 1/1980 | Wilcox | 404/6 |
| 4,236,843 | A | * | 12/1980 | Chisholm | 403/2 |
| 4,269,384 | A | | 5/1981 | Saeed et al. | 248/548 |
| 4,278,228 | A | * | 7/1981 | Rebentisch et al. | 248/548 |
| 4,295,637 | A | | 10/1981 | Hulek | 256/13.1 |
| 4,330,106 | A | * | 5/1982 | Chisholm | 256/13.1 |
| 4,389,134 | A | | 6/1983 | Colas | 403/263 |
| 4,399,980 | A | | 8/1983 | van Schle | 256/13.1 |
| 4,490,062 | A | * | 12/1984 | Chisholm | 403/2 |
| 4,583,716 | A | | 4/1986 | Stephen et al. | 256/13.1 |
| 4,607,824 | A | | 8/1986 | Krage et al. | 256/13.1 |
| 4,646,489 | A | | 3/1987 | Feller et al. | |
| 4,655,434 | A | * | 4/1987 | Bronstand | 256/13.1 |
| 4,678,166 | A | | 7/1987 | Bronstad et al. | 256/13.1 |
| 4,729,690 | A | | 3/1988 | Lavender et al. | 404/10 |
| 4,784,515 | A | | 11/1988 | Krage et al. | 404/6 |
| 4,815,565 | A | | 3/1989 | Sicking et al. | 188/32 |
| 4,838,523 | A | * | 5/1989 | Humble et al. | 256/13.1 |
| 4,852,847 | A | * | 8/1989 | Pagel | 248/548 |
| 4,923,319 | A | | 5/1990 | Dent | 403/2 |
| 4,926,592 | A | * | 5/1990 | Nehls | 256/13.1 X |
| 4,928,446 | A | | 5/1990 | Alexander, Sr. | 42/98 |
| 4,928,928 | A | | 5/1990 | But et al. | 256/13.1 |
| 4,986,687 | A | * | 1/1991 | Ivey | 403/2 |
| 5,022,782 | A | | 6/1991 | Gertz et al. | 404/6 |
| 5,078,366 | A | | 1/1992 | Sicking et al. | 256/13.1 |
| 5,203,543 | A | | 4/1993 | Fleury | 256/13.1 |
| 5,214,886 | A | | 6/1993 | Hugron | 52/98 |
| 5,286,137 | A | | 2/1994 | Cincinnati et al. | 404/6 |
| 5,288,137 | A | | 2/1994 | Cicinnati et al. | 404/6 |
| 5,391,016 | A | | 2/1995 | Ivey et al. | 404/6 |
| 5,407,298 | A | | 4/1995 | Sicking et al. | 404/6 |
| 5,484,217 | A | | 1/1996 | Carroll et al. | 403/2 |
| 5,503,495 | A | | 4/1996 | Mak et al. | 404/6 |
| 5,547,309 | A | | 8/1996 | Mak et al. | 404/6 |
| 5,657,966 | A | | 8/1997 | Cicinnati | 256/13.1 |
| 5,664,905 | A | | 9/1997 | Thompson et al. | 256/13.1 X |
| 5,797,591 | A | | 8/1998 | Krags | 256/13.1 |
| 5,988,598 | A | * | 11/1999 | Sicking et al. | 256/13.1 |
| 6,065,894 | A | | 5/2000 | Wasson et al. | 403/2 |
| 6,210,066 | B1 | | 4/2001 | Dent | 403/2 |

OTHER PUBLICATIONS

*Breakaway Metal Post for Highway Guardrail End Treatments* Patent ApplicationUSSN 09/074,496 filed May 7, 1998 James R. Albritton (091078.0554).

Communication from International Preliminary Examining Authority in connection with Application Serial No. PCT/US98/0929, Mar. 29, 2000.

International Search Report for PCT/US98/09029, Sep. 1, 1998.

ET–2000 The Future of Highway Safety—SYRO (Printed in Dec. 1990; revised Oct. 1992).

International Search Report for PCT/US99/30463, Apr. 28, 2000.

International Preliminary Examination Report for pending PCT Patent Application No. PCT/US99/30463, Mar. 21, 2001.*

Bronstad et al., *Modified Breakaway Cable Terminals for Guardrails and Median Barriers*, Research Results Digest, NCHRP, Transportation Research Board; Digest 12, May 1978.

* cited by examiner

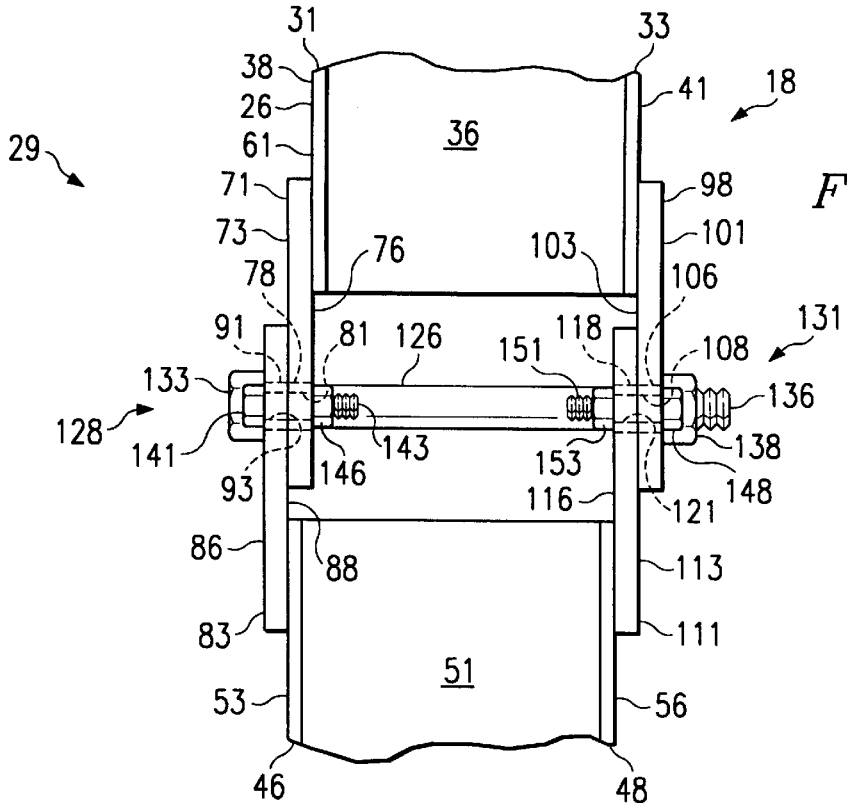
FIG. 2
FIG. 3
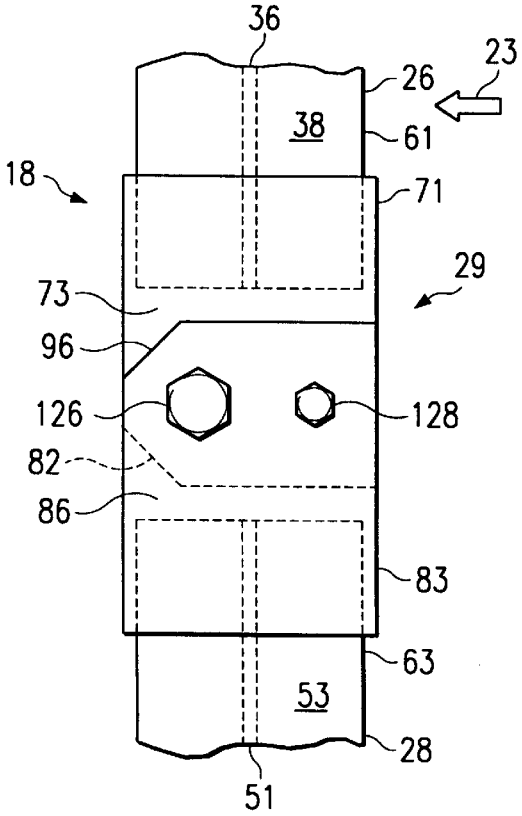
FIG. 4
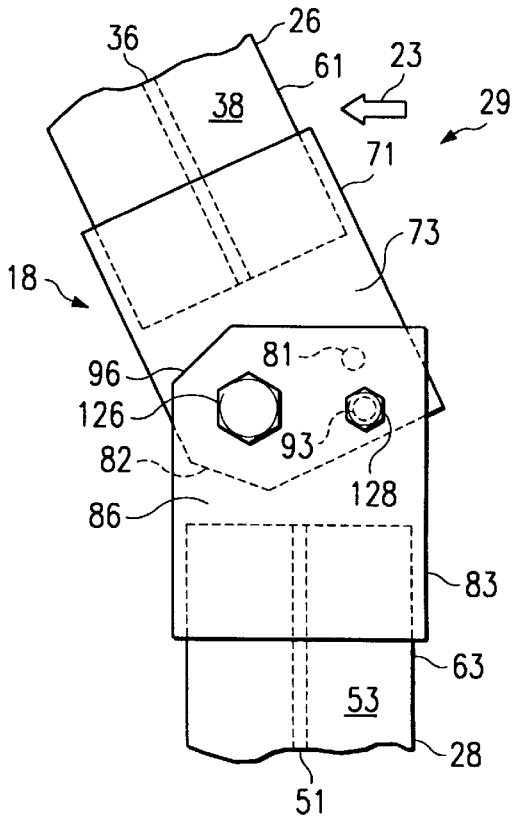

FIG. 8
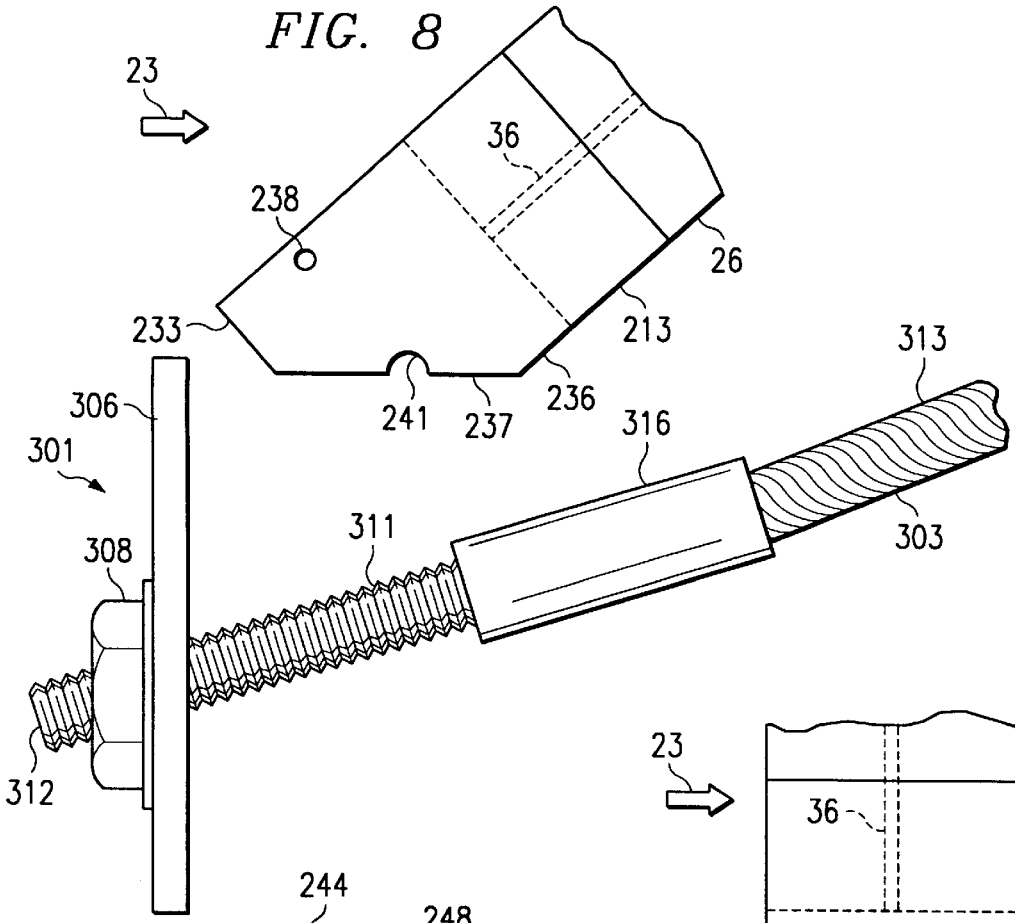
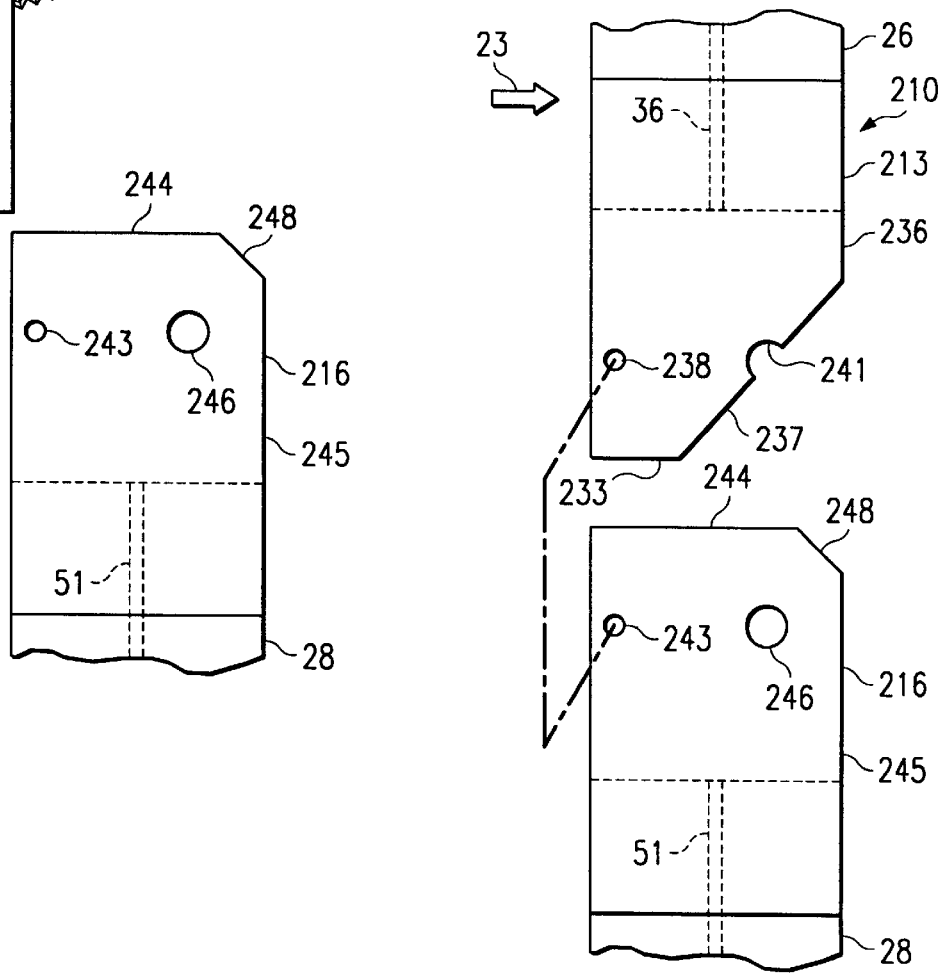
FIG. 7

BREAKAWAY SUPPORT POST FOR HIGHWAY GUARDRAIL END TREATMENTS

RELATED APPLICATION

This application claims the priority under 35 U.S.C. §119 of provisional application No. 60/115,122 filed Jan. 6, 1999.

TECHNICAL FIELD OF THE INVENTION

The present invention relates to highway guardrail systems having a guardrail mounted on posts, and more particularly, to guardrail end treatments designed to meet applicable federal and state safety standards including but not limited to crash worthiness requirements.

BACKGROUND OF THE INVENTION

Along most highways there are hazards which present substantial danger to drivers and passengers of vehicles if the vehicles leave the highway. To prevent accidents from a vehicle leaving a highway, guardrail systems are often provided along the side of the highway. Experience has shown that guardrails should be installed such that the end of a guardrail facing oncoming traffic does not present another hazard more dangerous than the original hazard requiring installation of the associated guardrail systems. Early guardrail systems often had no protection at the end facing oncoming traffic. Sometimes impacting vehicles became impaled on the end of the guardrail causing extensive damage to the vehicle and severe injury to the driver and/or passengers. In some reported cases, the guardrail penetrated directly into the passenger's compartment of the vehicle fatally injuring the driver and passengers.

Various highway guardrail systems and guardrail end treatments have been developed to minimize the consequences resulting from a head-on impact between a vehicle and the extreme end of the associated guardrail. One example of such end treatments includes tapering the ends of the associated guardrail into the ground to eliminate potential impact with the extreme end of the guardrail. Other types of end treatments include breakaway cable terminals (BCT), vehicle attenuating terminals (VAT), the SENTRE end treatment, and breakaway end terminals (BET).

It is desirable for an end terminal assembly installed at one end of a guardrail facing oncoming traffic to attenuate any head-on impact with the end of the guardrail and to provide an effective anchor to redirect a vehicle back onto the associated roadway after a rail face impact with the guardrail downstream from the end terminal assembly. Examples of such end treatments are shown in U.S. Pat. No. 4,928,928 entitled Guardrail Extruder Terminal, and U.S. Pat. No. 5,078,366 entitled Guardrail Extruder Terminal.

A SENTRE end treatment often includes a series of breakaway steel guardrail support posts and frangible plastic containers filled with sandbags. An impacting vehicle is decelerated as the guardrail support posts release or shear and the plastic containers and sandbags are compacted. A cable is often included to guide an impacting vehicle away from the associated guardrail.

A head-on collision with a guardrail support post located at the end of a guardrail system may result in vaulting the impacting vehicle. Therefore, guardrail end treatments often include one or more breakaway support posts which will yield or shear upon impact by a vehicle. Examples of previously available breakaway posts are shown in U.S. Pat. No. 4,784,515 entitled Collapsible Highway Barrier, and U.S. Pat. No. 4,607,824 entitled Guardrail End Terminal.

Posts such as shown in the '515 and the '824 Patents include a slip base with a top plate and a bottom plate which are designed to not yield upon lateral impact. When sufficient axial impact force is applied to the upper portion of the associated post, the top plate and the bottom plate will slide relative to each other. If a vehicle contacts the upper part of the post, the associated impact forces tend to produce a bending moment which may reduce or eliminate any slipping of the top plate relative to the bottom plate. Also, improper installation of the top plate relative to the bottom plate, such as over tightening of the associated mechanical fasteners, may prevent proper functioning of the slip base. A breakaway support post is also shown in U.S. Pat. No. 5,503,495 entitled Thrie-Beam Terminal with Breakaway Post Cable Release.

Wooden breakaway support posts are frequently used to releasably anchor guardrail end treatments and portions of the associated guardrail. Such wooden breakaway support posts, when properly installed, generally perform satisfactorily to minimize damage to an impacting vehicle during either a rail face impact or a head-on impact. However, impact of a vehicle with a wooden breakaway support post may often result in substantial damage to the adjacent soil. Removing portions of a broken wooden post from the soil is often both time consuming and further damages the soil. Therefore, wooden breakaway support posts are often installed in hollow metal tubes, sometimes referred to as foundation sleeves, and/or concrete foundations. For some applications, one or more soil plates may be attached to each metal sleeve to further improve the breakaway characteristics of the associated wooden post. Such metal sleeves and/or concrete foundations are relatively expensive and time consuming to install.

Light poles, sign posts or similar items are often installed next to a roadway with a breakable or releasable connection. For some applications, a cement foundation may be provided adjacent to the roadway with three or more bolts projecting from the foundation around the circumference of the pole. Various types of frangible or breakable connections may be formed between the bolts and portions of the light pole or sign post.

Other possible solutions to the problems discussed are found in U.S. patent application Ser. No. 09/074,496, filed May 7, 1998, entitled Breakaway Metal Post for Highway Guardrail End Treatments, and U.S. Provisional Application No. 60/046,015 filed May 9, 1997, entitled A Breakaway Metal Post for Highway Guardrail End Treatments. These solutions have been adequate for their intended purposes, but are not satisfactory in all respects. For example, previous breakaway support post designs have not included reusable parts. For another example, previous breakaway support post designs have included parts which require extensive machining.

SUMMARY OF THE INVENTION

From the foregoing, it may be appreciated that a need has arisen for an apparatus for a breakaway support post for mounting a guardrail thereon as part of a highway guardrail system which is cheaper and more reusable than previous designs. to According one form of the present invention, this need is met by such a breakaway support post which includes an elongated body having an upper portion including a first upper end and a first lower end, and a lower portion including a second upper end and a second lower end. The second lower end is insertable into the soil adjacent to a roadway. The first lower end has a first substantially vertical surface thereon and the second upper end has a second substantially vertical surface thereon. A first arrangement attaches the guardrail to the elongated body adjacent to the first upper end. A second arrangement rotatably couples the upper and lower potions, and releasably secures the upper portion of the elongated body generally aligned with the lower portion of the elongated body, wherein the breakaway support post will resist a rail face impact with the guardrail and wherein an impact with one end of the attached guardrail will tend to rotate the upper portion of the elongated body relative to the lower portion of the elongated body. The second arrangement includes a first plate having a first opening and a second opening therethrough, and having a third substantially vertical surface thereon. A portion of the third substantially vertical surface is disposed against a portion of the first substantially vertical surface. The first plate is secured to the first lower end by a weld. The second arrangement further includes a second plate having a third opening and a fourth opening therethrough, and having a fourth substantially vertical surface thereon. A portion of the fourth substantially vertical surface is disposed against a portion of the second substantially vertical surface. The second plate is secured to the second upper end by a weld. The second plate is disposed adjacent to the first plate so that the first opening is aligned with the third opening, and the second opening is aligned with the fourth opening. A pivot pin portion extends through the first and third openings. The upper portion of the elongated body is rotatable about the pivot pin portion relative to the lower portion of the elongated body. A shear pin portion extends through the second and fourth openings. The shear pin portion is adapted to shear in response to a force to allow pivotal movement of the upper portion relative to the lower portion around the pivot pin portion. The pivot pin portion and the shear pin portion extend in a strong direction approximately perpendicular to the plates. The support post exhibits a high mechanical strength in the strong direction, there also being a weak direction that is generally perpendicular to the strong direction, wherein the support post exhibits a low mechanical strength in the weak direction.

According to a different form of the present invention, a highway guardrail system includes an elongated guardrail. The highway guardrail system further includes a support post having a strong direction generally perpendicular to the guardrail, and a weak direction generally parallel to the guardrail, wherein the support post exhibits a high mechanical strength in the strong direction, and the support post exhibits a lower mechanical strength in the weak direction than in the strong direction, and the support post includes an elongated body having an upper portion and a lower portion, the lower portion being insertable into the soil adjacent to a roadway. The highway guardrail system further includes an attaching arrangement for attaching the guardrail to the support post adjacent to an upper end of the upper portion of the support post and a coupling arrangement for yieldly retaining the upper portion in an upright position relative to the lower portion, the coupling arrangement having a greater resistance to forces exerted on the upper portion in the strong direction than to forces exerted on the upper portion in the weak direction, and wherein in response to a force exerted in the weak direction which is greater than a predetermined amount of force, the coupling arrangement will permit the upper portion to move away from the upright position relative to the lower portion. The highway guardrail system further includes a cable having a first end and a second end, and a releasable arrangement for releasably maintaining the first end of the cable in an initial position relative to the post when the upper portion is in the upright position relative to the lower portion and for permitting the first end of the cable to move away from the initial position when the upper portion moves away from the upright position.

BRIEF DESCRIPTION OF THE DRAWINGS

For a more complete understanding of the present invention, and the advantages thereof, reference is now made to the following written description taken in conjunction with the accompanying drawings, in which:

FIG. 2 is a schematic drawing with portions broken away showing a side view of the breakaway support post of FIG. 1 in its upright position;

FIG. 3 is a schematic drawing with portions broken away showing a rear view of the breakaway support post of FIG. 1 in its upright position;

FIG. 4 is a schematic drawing similar to FIG. 3, but showing the breakaway support post rotating from its upright position to an angled position in response to a force applied to the breakaway support post in one direction corresponding with an impact by a vehicle with one end of the associated guardrail;

FIG. 7 is a schematic drawing of an exploded view of the breakaway support post in FIG. 5 showing only an upper portion and a lower portion thereof; and FIG. 8 is a schematic drawing with portions broken away showing a rear view of the breakaway support post of FIG. 5.

DETAILED DESCRIPTION OF THE INVENTION

The preferred embodiments of the present invention and its advantages are best understood by referring now in more detail to FIGS. 1–8 of the drawings, in which like numerals refer to like parts.

Figure 1:
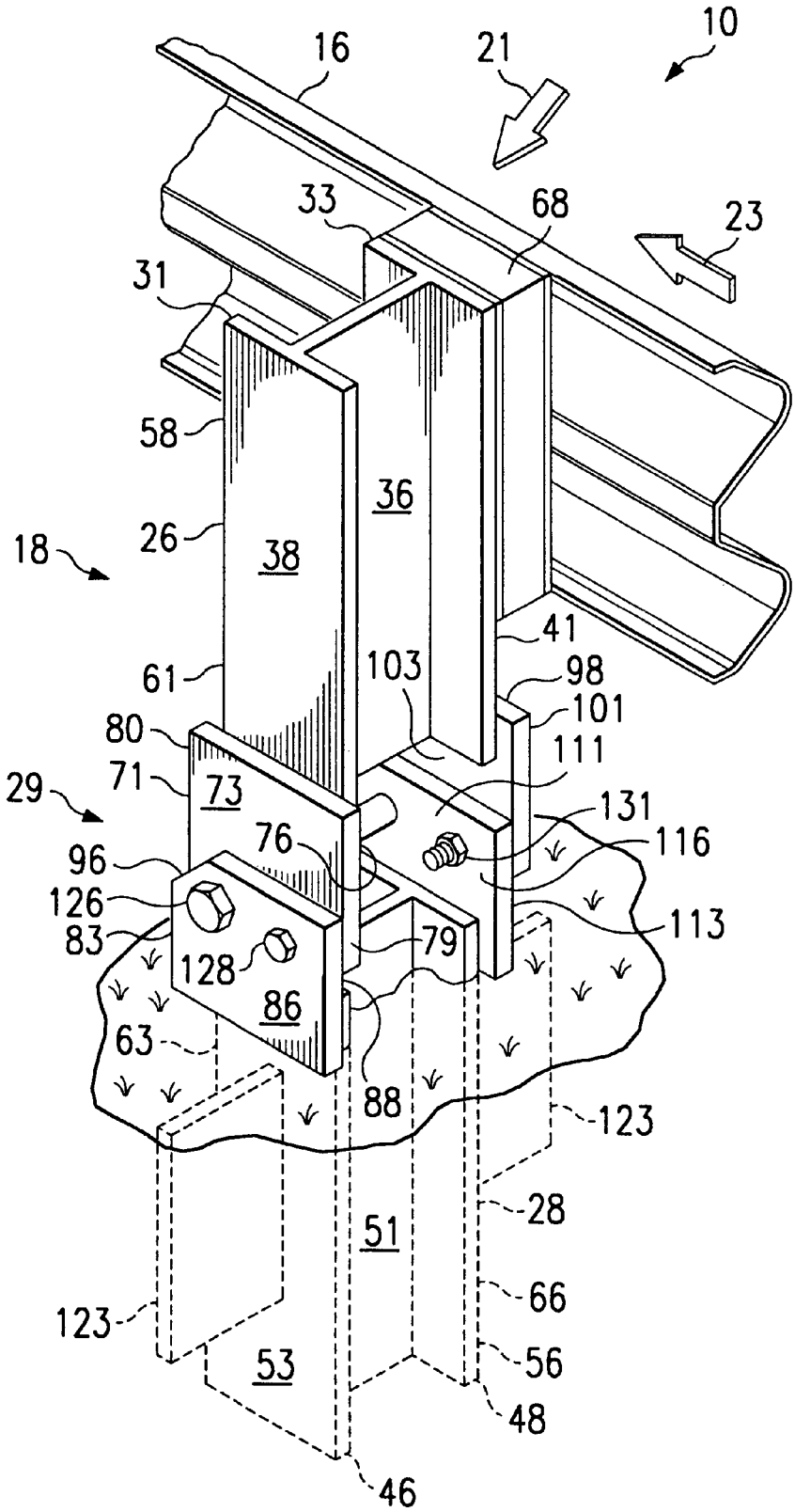
FIG. 1 is a schematic drawing showing an isometric view with portions broken away of a highway guardrail system having a breakaway support post with a guardrail mounted thereon in accordance with an embodiment of the present invention.

FIG. 1 is a schematic drawing showing an isometric view with portions broken away of a highway guardrail system 10 having a breakaway support post 18 with a guardrail 16 mounted thereon in accordance with an embodiment of the present invention. Referring to FIG. 1, the highway guardrail system 10 is typically installed along the edge of a highway or roadway (not expressly shown) adjacent to a hazard (not expressly shown) to prevent a vehicle (not shown), from leaving the associated highway or roadway.

Guardrail system 10 is primarily designed and installed along a highway to withstand a rail face impact from a vehicle downstream from an associated end treatment. Various types of guardrail end treatments (not expressly shown) are preferably provided at the end of guardrail 16 facing oncoming traffic. Examples of guardrail end treatments satisfactory for use with the present invention are shown in U.S. Pat. No. 4,655,434 entitled Energy Absorbing Guardrail Terminal; U.S. Pat. No. 4,928,928 entitled Guardrail Extruder Terminal; and U.S. Pat. No. 5,078,366 entitled Guardrail Extruder Terminal. Such guardrail end treatments extend substantially parallel with the associated roadway. U.S. Pat. No. 4,678,166 entitled Eccentric Loader Guardrail Terminal shows a guardrail end treatment which flares away from the associated roadway. U.S. Pat. Nos. 4,655,434; 4,928,928; 5,078,366; and 4,678,166 are incorporated herein by reference. When this type of guardrail end treatment is hit by a vehicle, the guardrail will normally release from the associated support post and allow the impacting vehicle to pass behind downstream portions of the associated guardrail. However, breakaway support posts incorporating teachings of the present invention may be used with any guardrail end treatment or guardrail system having satisfactory energy-absorbing characteristics for the associated roadway and anticipated vehicle traffic.

The support post 18 has a strong direction 21 and a weak direction 23. When the post is subjected to an impact from the strong direction 21, the post exhibits a high mechanical strength. The strong direction 21 is oriented perpendicular to the guardrail 16. Thus, when the post is impacted by a vehicle in the strong direction 21 (such as when the vehicle impacts the face of the guardrail), the post will remain intact and standing, and the vehicle will be redirected back onto the road. The weak direction 23 is oriented parallel to the guardrail. When the post is subjected to an impact from the weak direction 23, the post exhibits low mechanical strength. Thus, when the post is impacted by a vehicle in the weak direction 23 (such as when the vehicle impacts the end of the guardrail), the portion of the post that is substantially above the ground will yield, so as to avoid presenting a substantial barrier to the vehicle. Preferably, the upper portion of the post will deflect, in order to minimize lifting of the impacting vehicle into the air.

One or more support posts 18 are preferably incorporated into the respective guardrail end treatment to substantially minimize damage to a vehicle during a head-on impact with the end of guardrail 16 facing oncoming traffic. The number of support posts 18 and the length of guardrail 16 may be varied depending upon the associated roadway, the hazard adjacent to the roadway requiring installation of highway guardrail system 10, anticipated vehicle traffic on the associated roadway, and the selected guardrail end treatment. As discussed later in more detail, breakaway support posts 18 will securely anchor guardrail 16 during a rail face impact or front impact with guardrail 16 to redirect an impacting vehicle back onto the associated roadway. Support posts 18 will yield or buckle during a head-on impact with the end of guardrail 16 without causing excessive damage to an impacting vehicle.

Various techniques which are well known in the art may be satisfactorily used to install the breakaway support post 18, depending upon the type of soil conditions and other factors associated with the roadway and the hazard requiring installation of respective highway guardrail system 10. For many applications, the breakaway support post 18 may be simply driven into the soil using an appropriately sized hydraulic and/or pneumatic driver. As a result, the breakaway support post 18 may be easily removed from the soil using an appropriately sized crane or other type of pulling tool. For many applications, the breakaway post 18 may be satisfactorily used to install guardrail 16 adjacent to an associated roadway without the use of metal foundation tubes or other types of post-to-ground installation systems such as concrete with a steel slip base support. U.S. Pat. No. 5,503,495, entitled Thrie-Beam Terminal With Breakaway Post Cable Release, shows one example of a breakaway support post with this type of foundation.

Support posts 18 may be fabricated from various types of steel alloys or other materials with the desired strength and/or breakaway characteristics appropriate for the respective highway guardrail system 10. For some applications, a breakaway support post incorporating teachings of the present invention may be fabricated from ceramic materials or a mixture of ceramic and metal alloys which are sometimes referred to as cermets.

Referring to FIG. 1, the support post 18 includes an upper portion 26 and a lower portion 28 which are pivotally coupled by a rotatable coupling mechanism 29. Both the upper and lower portions 26 and 28 are steel I-beams. The upper portion 26 includes a flange 31 and a flange 33, with a web 36 extending between them. The flanges 31 and 33 are generally parallel to the guardrail 16. The web 36 is generally perpendicular to the flanges 31 and 33 and the guardrail 16. The flanges 31 and 33 have substantially vertical surfaces 38 and 41, respectively, on the sides thereof opposite the sides to which the web 36 is coupled. The rotatable coupling mechanism 29 includes four metal plates 71, 83, 98, and 111 and three bolts 126, 128, and 131. The mechanism 29 rotatably couples the upper portion 26 to the lower portion 28. In the described embodiment, the upper and lower portions 26 and 28 have the same general I-shaped cross-section. Alternatively, for some applications, the upper portion 26 could have a cross-section which is substantially different from the cross-section of the lower portion 28. For example, the upper portion 26 may be an I-beam, while the lower portion 28 may be a hollow or solid cylindrical post, or a hollow or solid square post, or some other shape.

The lower portion 28 includes a flange 46 and a flange 48, with a web 51 extending between them. The flanges 46 and 48 have substantially vertical surfaces 53 and 56 on the sides thereof opposite to the sides to which the web 51 is coupled. The flanges 46 and 48 are generally parallel to the guardrail 16 and are generally aligned in horizontal directions with the flanges 31 and 33, respectively. The web 51 is generally perpendicular to the flanges 46 and 48, and is generally aligned in horizontal directions with the web 36.

In FIG. 1, highway guardrail system 10 is shown with a typical deep W-beam twelve (12) gauge type guardrail 16. For some applications, a thrie beam guardrail may be satisfactorily used. Other types of guardrails, both folded and non-folded, may be satisfactorily used with the breakaway support post 18 of the present invention.

The upper portion 26 includes an upper end 58 and a lower end 61. The lower portion 28 includes an upper end 63 and a lower end 66. A block 68 forms a lateral offset between the guardrail 16 and the support post 18. The block 68 is fixedly coupled to the guardrail 16 and the support post 18.

A clearer understanding of the present invention is gained by considering FIGS. 1 and 2 together. FIG. 2 is a schematic drawing with portions broken away showing a side view of the breakaway support post 18 of FIG. 1 in its upright position.

Referring to FIGS. 1 and 2, the flat metal plate 71 has sides which are substantially vertical surfaces 73 and 76 and is of a generally rectangular shape. The plate 71 includes two horizontally spaced cylindrical openings 78 and 81 therethrough (shown in FIG. 2). The plate 71 further includes a first edge 79 and a second edge 80, the first edge 79 facing generally toward the direction of an expected impact in the weak direction 23, the second edge 80 facing generally away from the direction of the expected impact in the weak direction 23. The plate 71 further includes a chamfer 82 (shown in FIGS. 3–4) disposed between a bottom edge and a lower portion of the second edge 80 of the plate 71. In the disclosed embodiment, the chamfer extends at an angle of 45° with respect to each of the bottom edge and the second edge 80 of plate 71. The plate 71 is disposed against the substantially vertical surface 38 of the lower end 61 and is fixedly secured to the lower end 61 by a weld (not illustrated). The plate 71 is disposed against the lower end 61 such that a portion of the substantially vertical surface 76 overlaps a portion of the substantially vertical surface 38. The extent of the overlap between the plate 71 and the lower end 61 may be seen in greater detail in FIG. 2.

As mentioned above, the coupling mechanism 29 includes three additional plates 83, 98, and 111. These three additional plates are each substantially identical to plate 71, but are each described below for purposes of completeness. The flat metal plate 83 has a generally rectangular shape and has sides which are substantially vertical surfaces 86 and 88. The plate 83 includes two horizontally spaced cylindrical openings 91 and 93 therethrough (shown in FIG. 2). The plate 83 further includes a first edge and a second edge, the first edge facing generally toward the direction of an expected impact in the weak direction 23, the second edge facing generally away from the direction of the expected impact in the weak direction 23. The plate 83 further includes a chamfer 96 (also shown in FIGS. 3–4) disposed between a top edge and an upper portion of the second edge of the plate 83. The plate 83 is disposed against the upper end 63 and is fixedly secured to the upper end 63 by a weld (not-illustrated). The upper end of plate 83 is disposed adjacent and overlaps the lower end of plate 71 so that the cylindrical openings 78 and 91 are aligned, and the cylindrical openings 81 and 93 are aligned. A portion of the substantially vertical surface 88 remote from plate 71 is disposed adjacent to a portion of the substantially vertical surface 53.

The flat metal plate 98 is of a generally rectangular shape and has sides forming substantially vertical surfaces 101 and 103. The plate 98 includes two horizontally spaced cylindrical openings 106 and 108 therethrough (shown in FIG. 2). The plate 98 further includes a first edge and a second edge, the first edge facing generally toward the direction of an expected impact in the weak direction 23, and the second edge facing generally away from the direction of the expected impact in the weak direction 23. The plate 98 further includes a chamfer (not shown) disposed between a bottom edge and a lower portion of the second edge of the plate 98. The plate 98 is disposed against the lower end 61 and is fixedly secured to the lower end 61 by a weld (not-illustrated). A portion of the substantially vertical surface 103 is disposed against and overlaps a portion of the substantially vertical surface 41.

The flat metal plate 111 is of a generally rectangular shape and has sides that form substantially vertical surfaces 113 and 116. The plate 111 includes two horizontally spaced cylindrical openings 118 and 121 therethrough (shown in FIG. 2). The plate 111 further includes a first edge and a second edge, the first edge facing generally toward the direction of an expected impact in the weak direction 23, the second edge facing generally away from the direction of the expected impact in the weak direction 23. The plate 111 further includes a chamfer (not shown) disposed between a top edge and an upper portion of the second edge of the plate 111. The plate 111 is disposed against the upper end 63 and is fixedly secured to the upper end 63 by weld (not shown). A portion of the substantially vertical surface 116 is disposed against and overlaps a portion of the substantially vertical surface 56. The plates 98 and 111 are disposed adjacent and overlap each other so that the openings 106 and 118 are aligned, and the openings 108 and 121 are aligned.

The openings 78, 91, 106, and 118 are coaxial and are disposed closer to the second edges than to the first edges of the plates 71, 83, 98, and 111, respectively. The openings 81, 93, 108, and 121 are coaxial and are disposed closer to the first edges than to the second edges of the plates 71, 83, 98, and 111, respectively.

Referring to FIG. 2, a pivot bolt 126 extends through the aligned cylindrical openings 78, 91, 106, and 118 in the plates 71, 83, 98, and 111. The pivot bolt 126 rotatably couples the plate 83 to the plate 71, and the plate 98 to the plate 111. A shear bolt 128 extends through the cylindrical openings 81 and 93 in the plates 71 and 83. A further shear bolt 131 extends through the cylindrical openings 108 and 121 in the plates 98 and 111. The shear bolts 128 and 131 are generally vertically aligned with and are generally parallel to the pivot bolt 126. The shear bolt 128 releasably secures the plates 71 and 83 against relative rotational movement. The shear bolt 131 releasably secures the plates 98 and 111 against relative rotational movement. The shear bolts 128 and 131 each have a diameter smaller than the diameter of the pivot bolt 126.

The pivot bolt 126 has a head 133 and threads 136. A nut 138 engages the threads 136 to secure the pivot bolt 126 against axial movement within the openings 78, 91, 106, and 118. The head 133 is disposed against the substantially vertical surface 86 on the plate 83. The nut 138 is disposed against the substantially vertical surface 101 on the plate 98. The shear bolt 128 has a head 141 and threads 143. A nut 146 engages the threads 143 to secure the shear bolt 128 against axial movement within the openings 81 and 93. The head 141 is disposed against the substantially vertical surface 86 on the plate 83. The nut 146 is disposed against the substantially vertical surface 76 on the plate 71. The shear bolt 131 has a head 148 and threads 151. A nut 153 engages the threads 151 to secure the shear bolt 131 against axial movement within the openings 108 and 121. The head 148 is disposed against the substantially vertical surface 101 of the plate 98. The nut 153 is disposed against the substantially vertical surface 116 of the plate 111.

Depending on the length of the lower end 66 and the type of soil conditions, a plurality of soil plates 123 may be attached to the lower end 66 so as to extend outwardly from the flanges 46 and 48. As a result of increasing the length of the lower end 66, the use of the soil plates 123 may not be required.

FIG. 3 is a schematic drawing with portions broken away showing a rear view of the breakaway support post 18 of FIG. 1 in its upright position. FIG. 4 is a schematic drawing similar to FIG. 3, showing the breakaway support post 18 rotating from the upright position to the angled position in response to a force applied in the weak direction 23. In the upright position, the post 18 is upright with the upper portion 26 generally rectilinearly aligned with the lower portion 28. In the angled position, the upper portion 26 has rotated due to an impact from the weak direction 23 and forms an angle with respect to the lower portion 28.

Figure 5:
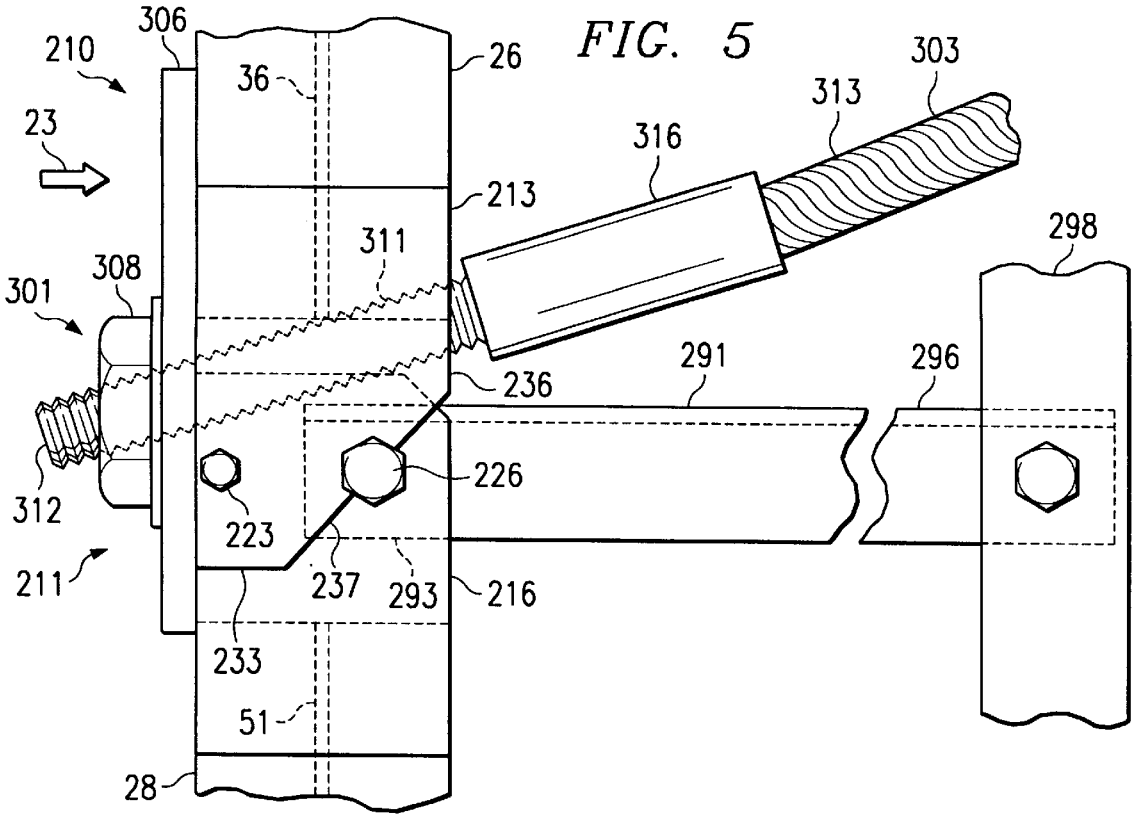
FIG. 5 is a schematic drawing with portions broken away showing a rear view of a further embodiment of the support post of FIG. 1 in an upright position.
Figure 6:
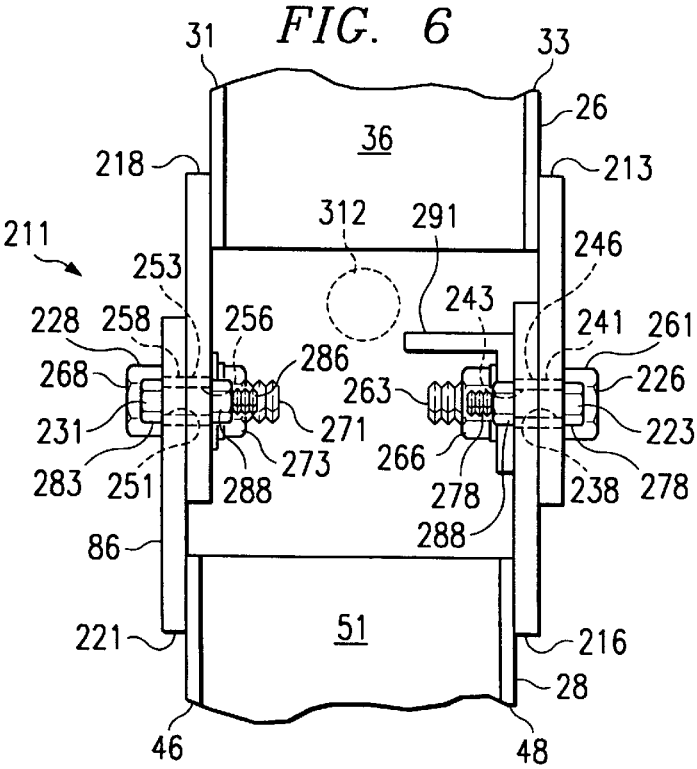
FIG. 6 is a schematic drawing with portions broken away showing a side view of the embodiment of the breakaway support post FIG. 5 in the upright position.

An alternative embodiment 210 of the breakaway support post 18 of FIG. 1 is shown in FIGS. 5, 6 and 7. Only the differences between these posts are described in detail below.

Referring to FIGS. 5 and 6, a releasable coupling assembly 211 rotatably couples the upper and lower portions 26 and 28 of the post, and includes four metal plates 213, 216, 218, and 221, and four bolts 223, 226, 228, and 231.

Referring to FIGS. 5, 6, and 7, the flat metal plate 213 includes a bottom edge 233 and a side edge 236, the side edge facing generally away from the direction of an expected impact in the weak direction 23. An inclined edge 237 faces downwardly and away from the direction of the expected impact in the weak direction 23, and in particular extends at an angle of 45° with respect to each of the bottom edge 233 and the side edge 236, and thus at an angle of 45° with respect to a vertical reference when the upper portion 26 is in the upright position. The plate 213 further includes a cylindrical opening 238 therethrough and a semicylindrical recess 241 disposed in the inclined edge 237 (FIG. 7). The plate 213 is disposed against the upper portion 26 such that a portion of the plate 213 overlaps a portion of the upper portion 26 and is fixedly secured to the upper portion 26 by a weld (not illustrated). The extent of the overlap between the plate 213 and the lower portion 26 may be seen in greater detail in FIG. 6.

The flat metal plate 216 has a generally rectangular shape. Plate 216 includes two horizontally spaced cylindrical openings 243 and 246 therethrough (FIG. 7). The plate 216 further includes a top edge 244 and a side edge 245, the side edge 245 facing generally away from the direction of the expected impact in the weak direction 23. The plate 216 further includes a chamfer 248 disposed between the top edge 244 and the side edge 255. The chamfer 248 extends at an angle of 45 degrees with respect to the top and side edges 244 and 245. The plate 216 is disposed against the lower portion 28 such that a portion of the plate 216 overlaps a portion of the lower portion 28 and is fixedly secured to the lower portion 28 by a weld (not illustrated). An upper end of plate 216 is disposed adjacent and overlaps the lower end of plate 213 (FIG. 6) so that the cylindrical openings 238 and 243 are aligned, and the recess 241 and the cylindrical opening 246 are aligned. The extent of the overlap between the plate 216 and the lower portion 28 may be seen in greater detail in association with FIG. 6.

The coupling assembly 211 includes two additional plates 218 and 221 as shown in FIG. 6. Plate 218 is substantially similar to plate 213, and plate 221 is substantially similar to plate 216.

More specifically, the plate 218 includes a cylindrical opening 251 similar to the cylindrical opening 238 and a semicylindrical recess 253 similar to the recess 241. The plate 221 includes two horizontally spaced cylindrical openings 256 and 258 similar to the cylindrical openings 243 and 246, respectively. Referring to FIG. 6, the openings 238 and 243 are coaxial, the openings 251 and 256 are coaxial, and the recess 241 and the opening 246 are coaxial. The opening 246, opening 258, recess 241, and recess 253 are each spaced horizontally in the direction 23 from openings 243, 256, 238, and 251, respectively.

Referring to FIGS. 5 and 6, a rigid strut 291 is generally L-shaped in cross-section and includes near one end a cylindrical opening therethrough (not shown). The strut 291 has a first end 293 disposed adjacent the plate 216 and coupled thereto by the pivot bolt 226 which extends through the cylindrical opening in the strut 291. The strut 291 further has a second end 296, opposite from the first end 293, coupled to a further support post 298.

The pivot bolt 226 extends through the cylindrical opening 246 and is engageable with the recess 241. The other pivot bolt 228 extends through the cylindrical opening 246, the opening in the strut 291, and is engageable with the recess 253. The pivot bolts 226 and 228 are also coaxial with each other.

The shear bolt 223 extends through the cylindrical openings 238 and 243. The other shear bolt 231, similar to shear bolt 226, extends through the cylindrical openings 243 and 253. The shear bolts 223 and 231 are generally vertically aligned with and parallel to the pivot bolts 226 and 228. The shear bolt 223 releasably secures the plates 213 and 216 against relative pivotal movement in one direction, and the shear bolt 231 releasably secures the plates 218 and 221 against relative pivotal movement in one direction. The shear bolts 223 and 231 each have a diameter smaller than the diameter of the pivot bolts 226 and 228.

The pivot bolt 226 has a head 261 and threads 263. A nut 266 engages the threads 263 to secure the pivot bolt 226 against axial movement relative with respect to plates 213 and 216, and strut 291. The nut 266 further secures the strut 291 against relative movement to the post 210. Similar to pivot bolt 226, the pivot bolt 228 has a head 268 and threads 271. A nut 273 engages the threads 271 to secure the pivot bolt 228 against axial movement relative to plates 218 and 221. The shear bolt 223 has a head 276 and threads 278. A nut 281 engages the threads 278 to secure the shear bolt 223 against axial movement within the openings 238 and 243. Similar to shear bolt 223, shear bolt 231 includes a head 283 and threads 286. A nut 288 engages the threads 286 to secure the shear bolt 231 against axial movement within the openings 251 and 256.

FIG. 8 is a schematic drawing with portions broken away showing a rear view of the breakaway support post 210 of FIG. 5 following a release of the coupling assembly 211. Referring to FIGS. 5 and 8, a cable 303 and a releasable cable coupling mechanism 301 are shown. The releasable coupling mechanism 301 includes an anchor plate 306 and a nut 308. The cable may be any of a variety of industry standard metal cables.

The anchor plate 306 is a flat metal plate of a generally rectangular shape. The anchor plate 306 has an aperture therethrough (not shown). As shown in FIG. 5, the anchor plate 306 is normally disposed against the lower end of the upper portion 26. The anchor plate 306 may also overlap the lower portion 28 or be in some other appropriate location with respect to the support post 210.

The cable 303 has a first end portion 311 and a second end portion (not shown) at a remote end. The second end portion is coupled to the highway guardrail system 10 at a location remote from the first end portion. In this embodiment, the first end portion 311 includes a threaded stud 312. The cable further includes a flexible portion 313 and a mating part 316. The mating part 316 couples the flexible portion 313 to the threaded stud 312. The first end portion 311 extends through the aperture of the anchor plate 306 and further extends away from the anchor plate 306 between the upper and lower portions 26 and 28. The cable 303 engages the web 36, but could alternatively engage the web 51, or further extend in some other appropriate manner away from the anchor plate 306. The first end portion of the cable 311 is fixedly secured against withdrawal from the opening in the anchor plate 306 by the nut 308 which engages the threaded stud 312.

The breakaway support post 18 of FIGS. 1–4 operates as follows. In the upright position of the upper portion 26 (FIG. 3), the upper and lower portions 26 and 28 are generally parallel. The coupling mechanism 29 prevents the upper portion 26 from rotating relative to the lower portion 28 around the pivot bolt 126. When a vehicle impacts the guardrail system 10 with sufficient force from the weak direction 23, the shear bolt 128 will be sheared by scissors-like interaction of the plates 71 and 83, and the shear bolt 131 will be sheared by scissors-like interaction of the plates 98 and 111. The pivot bolt 126 does not fail during the impact because the pivot bolt 126 has a diameter large enough to avoid failure, and in particular has a larger diameter than the diameter of the shear bolts 128 and 131. Once the shear bolts fail, the upper portion 26 will rotate away from the impacting vehicle about the pivot bolt 126. The openings 81 and 93 (shown in FIG. 4) and the openings 108 and 121 (not shown in FIG. 4) move out of alignment as the upper portion 26 rotates. Chamfers 82 and 96 allow the upper portion 26 to rotate while avoiding engagement of the plates 71, 83, 98, and 111 with the webs 36 and 51 and the flanges 31, 33, 46, and 48. The rotation of the upper portion 26 will collapse the guardrail 16 and protect the occupants of the impacting vehicle from being impaled on the guardrail 16.

The further embodiment of the breakaway support post shown as 210 in FIGS. 5–8 operates as follows. In the upright position (shown in FIG. 5), the upper and lower portions 26 and 28 are generally parallel. As shown in FIG. 5, the anchor plate 306 is disposed against the upper portion 26 when the upper portion 26 is in the upright position, and the cable 303 is maintained under tension. The anchor plate 306 operates to secure the cable 303 against relative movement with respect to the support post 210.

The releasable coupling assembly 211 allows the upper portion 26 to separate from the lower portion 28 in response to a force in the weak direction 23. When a vehicle impacts the breakaway support post 210 with sufficient force in the weak direction 23, the shear bolt 223 will be sheared by scissors-like interaction of the plates 213 and 216, and the shear bolt 231 will be sheared by scissors-like interaction of the plates 218 and 221. The pivot bolts 226 and 228 do not fail during the impact because the pivot bolts 226 and 228 have a diameter large enough to avoid failure, and, in particular, have a diameter larger than the diameter of the shear bolts 223 and 231. Once the shear bolts 223 and 231 have failed the upper portion 26 will typically pivot a small amount about the pivot bolts 226 and 228, and then physically separate from the lower portion 28 (FIG. 8).

As shown in FIG. 8, as the upper portion 26 physically separates from the lower portion 28 the anchor plate 306 is no longer secured by the upper portion 26. Thus, the anchor plate 306 is able to move away from the anchor plate's initial position. Thus, once the anchor plate 306 is released from the upper portion 26 the cable 303 is also free to move while remaining coupled to the anchor plate.

The present invention provides a number of technical advantages. One such technical advantage is the capability of the support post to yield in response to the impact of a vehicle at the end of a guardrail. Yielding in response to the impact by the vehicle results in a decreased chance of injury to occupants of the vehicle. Another advantage is that the flat metal plates can be fabricated rapidly and inexpensively. A further advantage is that the plates are welded onto standard I-beams, which allows the support post to be made easily and cheaply. Moreover, the pivot and shear bolts may be commercially available components, which also reduces the overall cost of manufacturing the post. Further cost savings are realized by reusing the upper and lower portions after an impact, by replacing only the shear bolts. If the upper portion is damaged by an impact, only the upper portion and the shear bolts need to be replaced, and cost savings are realized by reusing the lower portion. When a cable is present, a simple and inexpensive retaining arrangement is provided to retain an end of the cable until an impact occurs, and to then release the end of the cable so that it can move freely. Further, a simple and inexpensive arrangement is provided which permits an upper portion of a post to separate from a lower portion following an impact.

Although one embodiment has been illustrated and described in detail, it should be understood that various changes, substitutions, and alterations can be made therein without departing from the scope of the present invention. For example, although the disclosed support post is an I-beam, a square support post with a hollow center could be used instead. Other changes, substitutions, and alternations are also possible without departing from the spirit and scope of the present invention, as defined by the following claims.

What is claimed is:

1. A breakaway support post for mounting a guardrail thereon as part of a highway guardrail system, comprising:

an elongated body having an upper portion including a first upper end and a first lower end, and a lower portion including a second upper end and a second lower end, the second lower end having a configuration for installation adjacent to a roadway, and the first lower end having a first substantially vertical surface thereon and the second upper end having a second substantially vertical surface thereon;

a first means for attaching a guardrail to the elongated body adjacent to the first upper end;

a second means for rotatably coupling the upper and the lower portions and for releasably securing the upper portion of the elongated body generally aligned with the lower portion of the elongated body, wherein the breakaway support post is for resisting a rail face impact with a guardrail is attached to the support post and wherein an impact with one end of a guardrail system incorporating the support post will tend to rotate the upper portion of the elongated body relative to the lower portion of the elongated body; wherein the second means includes a first plate having a first opening and a second opening therethrough, and a third substantially vertical surface thereon, a portion of the third substantially vertical surface being disposed against a portion of the first substantially vertical surface, and the first plate being secured to the first lower end by a weld;

a second plate having a third opening and a fourth opening therethrough, and a fourth substantially vertical surface thereon, a portion of the fourth substantially vertical surface being disposed against a portion of the second substantially vertical surface, the second plate being secured to the second upper end by a weld, the second plate being disposed adjacent to the first plate so that the first opening is aligned with the third opening, and the second opening is aligned with the fourth opening;

a pivot pin portion extending through the first and the third openings, the upper portion of the elongated body being rotatable about the pivot pin portion relative to the lower portion of the elongated body;

a shear pin having a shear pin portion extending through the second and the fourth openings, the shear pin portion being adapted to shear in response to a force to allow pivotal movement of the upper portion relative to the lower portion around the pivot pin portion, the pivot pin portion and the shear pin portion extending in a strong direction approximately perpendicular to the plates, wherein the support post exhibits a high mechanical strength in the strong direction, there being a weak direction generally perpendicular to the strong direction, wherein the support post exhibits a low mechanical strength in the weak direction; and the first and second plates each have a first edge and a second edge, the first edge facing generally toward the weak direction, and the second edge facing generally away from the weak direction, wherein the first plate further includes a chamfer disposed between a bottom edge thereof and a lower portion of the second edge thereof, and wherein the second plate further includes a chamfer disposed between a top edge thereof and an upper portion of the second edge thereof, the chamfers being positioned so that the first plate does not engage the lower portion and the second plate does not engage the upper portion when the upper portion of the elongated body rotates relative to the lower portion of the elongated body.

2. A breakaway support post for mounting a guardrail thereon as part of a highway guardrail system, comprising:

an elongated body having an upper portion including a first upper end and a first lower end, and a lower portion including a second upper end and a second lower end, the second lower end having a configuration for installation adjacent to a roadway, and the first lower end having a first substantially vertical surface thereon and the second upper end having a second substantially vertical surface thereon;

a first means for attaching a guardrail to the elongated body adjacent to the first upper end;

a second means for rotatably coupling the upper and the lower portions and for releasably securing the upper portion of the elongated body generally aligned with the lower portion of the elongated body, wherein the breakaway support post is for resisting a rail face impact when the guardrail is attached to the support post and wherein an impact with one end of a guardrail system incorporating the support post will tend to rotate the upper portion of the elongated body relative to the lower portion of the elongated body, wherein the second means includes:

a first plate having a first opening and a second opening therethrough, and a third substantially vertical surface thereon, a portion of the third substantially vertical surface being disposed against a portion of the first substantially vertical surface, and the first plate being secured to the first lower end by a weld;

a second plate having a third opening and a fourth opening therethrough, and a fourth substantially vertical surface thereon, a portion of the fourth substantially vertical surface being disposed against a portion of the second substantially vertical surface, the second plate being secured to the second upper end by a weld, the second plate being disposed adjacent to the first plate so that the first opening is aligned with the third opening, and the second opening is aligned with the fourth opening;

a pivot pin portion extending through the first and the third openings, the upper portion of the elongated body being rotatable about the pivot pin portion relative to the lower portion of the elongated body;

a shear pin having a shear pin portion extending through the second and the fourth openings, the shear pin portion being adapted to shear in response to a force to allow pivotal movement of the upper portion relative to the lower portion around the pivot pin portion, the pivot pin portion and the shear pin portion extending in a strong direction approximately perpendicular to the plates, wherein the support post exhibits a high mechanical strength in the strong direction, there being a weak direction generally perpendicular to the strong direction, wherein the support post exhibits a low mechanical strength in the weak direction;

a fifth substantially vertical surface on a side of the upper portion opposite the side having the first substantially vertical surface;

a sixth substantially vertical surface on a side of the lower portion opposite the side having the second substantially vertical surface;

a third plate having fifth and sixth openings therethrough, and a seventh substantially vertical surface thereon, a portion of the seventh substantially vertical surface being disposed against the fifth substantially vertical surface, and the third plate being secured to the first lower end by a weld;

a fourth plate having seventh and eighth openings therethrough, and an eighth substantially vertical surface thereon, a portion of the eighth substantially vertical surface being disposed against the sixth substantially vertical surface, the fourth plate being secured to the second upper end by a weld, the fourth plate being disposed against the third plate, so that the fifth opening is aligned with the seventh opening and the sixth opening is aligned with the eighth opening, and the pivot pin portion further extending through the fifth and seventh openings in the strong direction;

a further shear pin portion extending through the sixth and the eighth openings in the strong direction, the further shear pin portion being adapted to shear in response to a force to allow pivotal movement of the upper portion relative to the lower portion around the pivot pin portion; and the third and fourth plates each have a first edge and a second edge, the first edge facing generally toward the weak direction, and the second edge facing generally away from the weak direction, wherein the third plate further includes a chamfer disposed between a bottom edge thereof and a lower portion of the second edge thereof, and wherein the fourth plate further includes a chamfer disposed between a top edge thereof and an upper portion of the second edge thereof, the chamfers being positioned so that the third plate does not engage the lower portion and the fourth plate does not engage the upper portion when the upper portion of the elongated body rotates relative to the lower portion of the elongated body free of engagement between the fourth and third plates and the upper and lower portions, respectively.

3. A breakaway support post for mounting a guardrail thereon as part of a highway guardrail system, comprising:

an elongated body having an upper portion and a lower portion, the upper portion of the elongated body having a first end, the lower portion of the elongated body having a second end which may be installed adjacent to a roadway;

a first means for attaching a guardrail adjacent to the first end of the upper portion; and a second means for rotatably coupling the upper and the lower portions and for releasably securing the upper portion of the elongated body generally aligned with the lower portion of the elongated body, wherein the breakaway support post is for resisting a rail face impact when the guardrail is attached, and wherein an impact with one end of the guardrail will tend to rotate the upper portion of the elongated body relative to the lower portion of the elongated body, wherein the second means includes:

a first plate coupled to the upper portion, the first plate having a first opening and a second opening therethrough;

a second plate coupled to the lower portion, the second plate having a third opening and a fourth opening therethrough, a portion of the first plate being disposed adjacent to a portion of the second plate so that the first and the third openings are aligned and the second and fourth openings are aligned;

a pivot bolt extending through the first and the third openings;

a shear bolt extending through the second and the fourth openings and being adapted to shear in response to a force to allow pivotal movement of the upper portion relative to the lower portion around the pivot bolt;

the shear bolt having a diameter less than the diameter of the pivot bolt;

the pivot bolt and the shear bolt extending in a strong direction approximately perpendicular to the plates, wherein the support post exhibits a high mechanical strength in the strong direction;

the support post having a weak direction generally perpendicular to the strong direction, wherein the support post exhibits a low mechanical strength in the weak direction;

a third plate coupled to the upper portion on a side opposite the first plate, the third plate having a fifth opening and a sixth opening therethrough;

a fourth plate coupled to the lower portion on a side opposite the second plate, the fourth plate having a seventh opening and an eighth opening therethrough, a portion of the third plate being disposed adjacent to a portion of the fourth plate so that the fifth and the seventh openings are aligned and the sixth and the eighth openings are aligned, and the pivot bolt further extending through the fifth and the seventh openings in the strong direction;

a further shear bolt extending through the sixth and the eighth openings in the strong direction, the shear bolts being co-axial with each other, the further shear bolt having a head at one end, and threads at an opposite end and including a further nut, the further nut engaging the threads of the further shear bolt, the further shear bolt having a diameter less than the diameter of the pivot bolt, and the further shear bolt being adapted to shear in response to a force to allow pivotal movement of the upper portion relative to the lower portion around the pivot bolt;

the shear bolt and the pivot bolt are generally vertically aligned with each other and wherein the first and the second plates each have a first edge facing toward the weak direction and a second edge facing away from the weak direction, the pivot bolt being disposed closer to the second edge of the plates than to the first edge thereof, and wherein the shear bolts are disposed closer to the first edge than to the second edge thereof; and a first chamfer disposed between a bottom edge and a lower portion of the second edge of the first plate, and a second chamfer disposed between a top edge and an upper portion of the second edge of the second plate, the chamfers being positioned so that the first plate does not engage the lower portion and the second plate does not engage the upper portion when the upper portion of the elongated body rotates relative to the lower portion of the elongated body.

* * * * *